US009469147B2

(12) United States Patent
Yoshida

(10) Patent No.: US 9,469,147 B2
(45) Date of Patent: Oct. 18, 2016

(54) PAPER HOLDER

(71) Applicant: GI Technos Inc., Toshima-ku, Tokyo (JP)

(72) Inventor: Tsukasa Yoshida, Saitama (JP)

(73) Assignee: GI Technos Inc., Tokyo (JP)

( * ) Notice: Subject to any disclaimer, the term of this patent is extended or adjusted under 35 U.S.C. 154(b) by 0 days.

(21) Appl. No.: 14/383,190

(22) PCT Filed: Mar. 6, 2013

(86) PCT No.: PCT/JP2013/056876
§ 371 (c)(1),
(2) Date: Sep. 5, 2014

(87) PCT Pub. No.: WO2013/141093
PCT Pub. Date: Sep. 26, 2013

(65) Prior Publication Data

US 2015/0026929 A1 Jan. 29, 2015

(30) Foreign Application Priority Data

Mar. 22, 2012 (JP) ..... 2012-066413

(51) Int. Cl.
*B42F 9/00* (2006.01)
*B42F 1/00* (2006.01)
(Continued)

(52) U.S. Cl.
CPC ..... *B42F 1/006* (2013.01); *B42F 1/02* (2013.01); *B42F 15/0029* (2013.01); *Y10T 24/204* (2015.01)

(58) Field of Classification Search
CPC ... B42F 1/006; B42F 15/0029; Y10T 24/209
USPC ..... 24/67.7, 67 R, 67 P, 67.3, 67.5
See application file for complete search history.

(56) References Cited

U.S. PATENT DOCUMENTS 2,234,086 A * 3/1941 Rosebraugh ..... A47B 23/004 24/67.7
2,371,713 A * 3/1945 Short ..... B42F 19/00 220/549

(Continued)

FOREIGN PATENT DOCUMENTS

JP 3008170 U 3/1995
JP 3775222 B2 5/2006

(Continued)

OTHER PUBLICATIONS

International Search Report for PCT/JP2013/056876 dated Apr. 9, 2013.

(Continued)

*Primary Examiner* — David E Sosnowski
*Assistant Examiner* — Jason W San
(74) *Attorney, Agent, or Firm* — Sughrue Mion, PLLC

(57) ABSTRACT

The paper holder includes: a case having a front portion, a back portion, an upper portion, and an insertion opening for inserting the paper; and a holding piece having a blade in such a manner as to project from an end thereof on the front portion side, the holding piece being axially supported rotatably, and biased by spring force in the paper pulling direction. The back portion includes an extended back portion formed extending further downward than a lower end portion of the front portion, and an inclined portion extending substantially linearly from a lower end portion of the extended back portion in the paper insertion direction, when viewed from the side, and the front portion has transparency.

14 Claims, 7 Drawing Sheets

(51) Int. Cl.
*B42F 15/00* (2006.01)
*B42F 1/02* (2006.01)

(56) References Cited

U.S. PATENT DOCUMENTS 2,486,253 A * 10/1949 Bresler ..... B42F 7/14 24/67.7
2,607,070 A * 8/1952 Wertz ..... A22C 25/06 24/507
3,065,668 A * 11/1962 Leybourn ..... G09B 29/10 116/240
3,212,146 A * 10/1965 Morgan ..... B43K 23/001 24/10 R
3,359,986 A * 12/1967 Koenders ..... B42F 15/0029 211/46
3,425,389 A * 2/1969 Arcieri ..... B42F 21/00 116/236
3,560,092 A * 2/1971 Coney ..... B42F 9/001 24/67.7
3,639,020 A * 2/1972 Nesbitt ..... B42F 15/0023 229/67.2
3,828,402 A * 8/1974 Gorman ..... B42F 9/001 108/43
4,056,193 A * 11/1977 Yoshida ..... G06K 13/16 211/51
4,241,477 A * 12/1980 Freedom ..... B42F 1/02 24/67 P
4,253,216 A * 3/1981 Brown ..... A44B 99/00 24/335
4,970,813 A * 11/1990 Ackeret ..... G09F 11/30 40/511
5,112,083 A * 5/1992 Morrone ..... B42F 9/00 281/44
5,193,795 A * 3/1993 Ackeret ..... B65H 3/02 271/42
5,305,501 A * 4/1994 Ockba ..... B42F 1/006 24/508
6,470,536 B1 * 10/2002 Kettlestrings ..... B42F 9/002 24/67
6,681,452 B1 * 1/2004 Holland ..... B42F 1/006 221/33
7,614,598 B2 * 11/2009 Smith ..... B42F 9/001 24/67 R
7,874,758 B2 * 1/2011 Tanaka ..... B42F 9/001 24/67.11
8,425,139 B2 * 4/2013 Chan ..... B26D 7/015 24/67.3
8,876,165 B1 * 11/2014 Maggi ..... B42F 9/002 24/67.5
2003/0172570 A1 * 9/2003 Yoshida ..... B42F 1/02 40/658
2008/0196211 A1 * 8/2008 Cheng ..... B42F 9/001 24/67.7
2008/0258452 A1 * 10/2008 Yoshida ..... B42F 15/066 281/45
2012/0260466 A1 * 10/2012 Yoshida ..... B42F 1/006 24/67.7

FOREIGN PATENT DOCUMENTS

JP 2011-131502 A 7/2011
JP 2012-121203 A 6/2012
WO 2008/096463 A1 8/2008
WO 2009/116190 A1 9/2009
WO 2010/073812 A1 7/2010
WO 2011/077794 A1 6/2011

OTHER PUBLICATIONS

Written Opinion for PCT/JP2013/056876 dated Apr. 9, 2013.

* cited by examiner

PAPER HOLDER

TECHNICAL FIELD

The present invention relates to a paper holder that allows multiple sheets of paper to be simultaneously inserted into the holder with ease and to be reliably held in a hanging state; allows the paper to be reliably pulled out one by one from the front side without dropping other sheets; and allows the pulled sheet to be provided with a straight, neat tear on the paper.

BACKGROUND ART

Conventionally, there are various kinds of paper holders for holding and fixing paper, and a known common structure thereof includes a paper insertion opening on one side of a case and a paper-holding member in the case.

In addition, the Patent Document 1 according to the application by the present applicant describes "A paper holder including a case including a mount portion that includes a bottom surface portion, and an upper covering portion having an upper surface portion disposed with a space from the bottom surface portion and facing to the bottom surface portion substantially in parallel, and, at a front end of the upper surface portion, a front side front portion substantially in a U-shape when viewed from the side, the mount portion and the upper covering portion being detachably engaged and integrated with each other, an insertion opening for paper being formed below the front side front portion; a holding piece that is provided in the case for holding inserted paper; an elastic member that biases the holding piece by means of spring force applied in a direction in which the paper is pulled out; and a blade that is provided to the holding piece, wherein the holding piece is formed with a plate body having rigidity and is axially supported rotatably by an axial support portion that is provided inside the front side front portion, and the holding piece further includes a base plate portion that extends from the axial support portion to the bottom surface portion, the blade is fixed to a blade fixing member that holds a perpendicular standing state of the blade with respect to the holding piece, the blade fixing member is provided in a surface of the base plate portion on a paper insertion direction side such that a pointed end of the blade projects from an end of the base plate portion on the bottom surface portion side, and a friction portion for preventing the inserted paper from dropping is provided in an inner surface of the bottom surface portion".

The paper holder described in Patent Document 1 takes effect that "paper is reliably held; the held paper can be reliably pulled out, one by one, from top; the pulled sheet has a straight, neat tear made on the paper by the blade; and dust is hardly generated."

CITATION LIST

Patent Literature

Patent Document 1: JP-A-2011-131502

SUMMARY OF THE INVENTION

Problems to be Solved by the Invention

The present invention is an improvement in the paper holder described in Patent Document 1. An object of the present invention is to provide a paper folder described below. The paper holder is suitable for use for reliably holding multiple sheets of paper in a hanging state in production factories, commercial activities such as transport, and business spaces such as business offices. In addition, the paper holder allows people to easily visually recognize the held paper and is excellent in usability.

Solutions to the Problems

A paper holder includes: a case including a front portion, a back portion disposed with a space from the front portion and facing to the front portion substantially in parallel, an upper portion for connecting the front portion and the back portion, and an insertion opening for inserting paper into between the front portion and the back portion from below; and a holding piece axially rotatably supported by an axial support portion provided inside the case and biased by a spring force in a direction of pulling out the paper, and including a blade configured to project from an end of the holding piece toward the front portion, a pointed end of the blade being configured to be brought into contact with the paper inserted from the insertion opening to hold the paper. The back portion includes an extended back portion formed extending further downward than a lower end portion of the front portion, and an inclined portion extending substantially linearly from a lower end portion of the extended back portion in the paper insertion direction, when viewed from the side, the axial support portion is provided on an inner side of the inclined portion, and the front portion has transparency.

Effects of the Invention

The present invention can reliably hold paper in a hanging state in production factories, commercial activities such as transport, and business spaces such as business offices.

Paper inserted from an insertion opening is reliably held by spring force of an elastic member that acts on a holding piece while being thrust by a pointed end of the blade. The held paper can be reliably pulled out, one by one, from a front side (a front portion side). The pulled sheet has a straight, neat tear. Dust is hardly generated.

Moreover, a back portion includes an extended back portion formed extending further downward than a lower end portion of the front portion. In addition, the back portion includes an inclined portion extending substantially linearly from a lower end portion of the extended back portion in the paper insertion direction, in side view. Hence, when paper is inserted, the paper is smoothly guided to the insertion opening in a reliable manner. Hence, its usability is excellent.

The front portion has transparency. Any of the holding piece and other members is not disposed between the front portion and a sheet of paper on the front side (the front portion side), the sheet being pulled out first among multiple sheets. Hence, the entire surface of the frontmost sheet among the held paper can be recognized through the front portion. Hence, its usability is excellent.

DESCRIPTION OF EMBODIMENT

Figure 1:
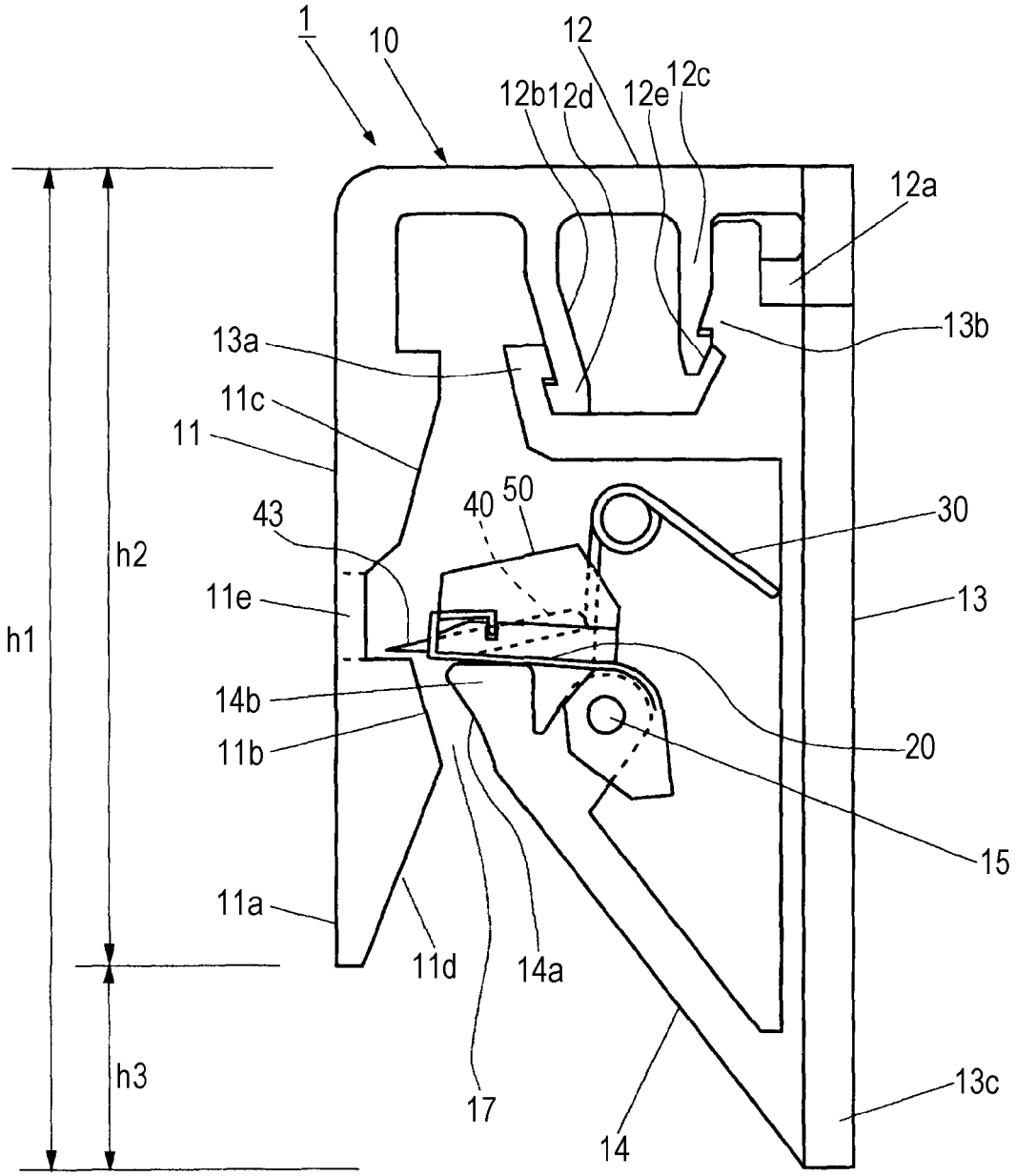
FIG. 1 is a side view of a paper holder 1.

An embodiment of the present invention is described with reference to the drawings. The present invention is not limited to the following embodiment.

Embodiment

Case

A paper holder 1 includes a case 10 and a holding piece 2 placed in the case 10.

The case 10 includes a front portion 11, a back portion 13 disposed with a space from the front portion 11 and facing to the front portion 11 substantially in parallel, and an upper portion 12 connecting the front portion 11 and the back portion 13. The upper portion 12 is connected to the front portion in an integrated manner. The case 10 is formed of a combination of two synthetic resin molded products having different cross sections, which are the front portion 11 and the upper portion 12, and the back portion 13. Both are detachably engaged and integrated with each other. An insertion opening 17 for inserting paper from below is formed between the front portion 11 and the back portion 13.

Figure 2:
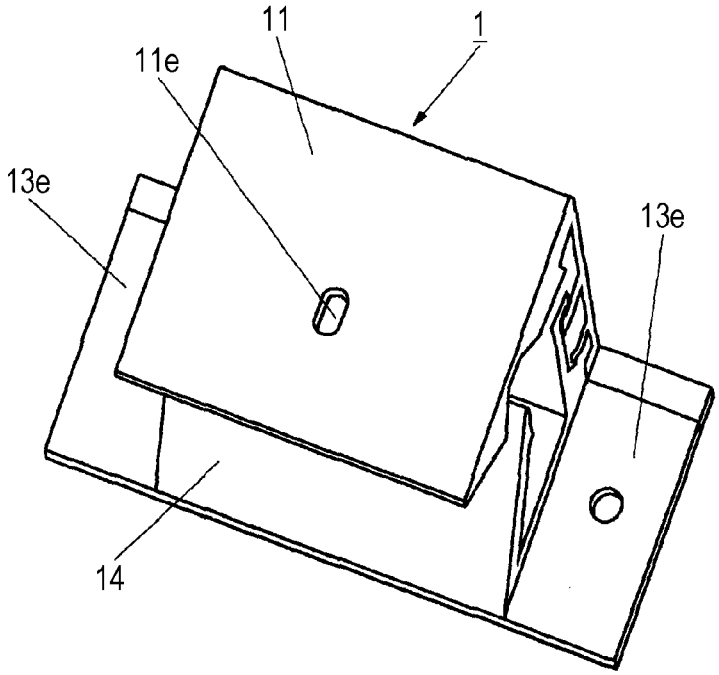
FIG. 2 is a perspective view of the paper holder 1.

As illustrated in FIG. 2, overhang portions 13*e* are provided on both sides of the back portion 13. The overhang portions 13*e* serve as mounting portions used to attach the paper holder 1 to a plate material or the like as described below.

The size of the case 10 is not limited. Examples of the size include a height of approximately 3 to 6 cm, a depth of approximately 2 to 3 cm, and a width of approximately 4 to 7 cm (including the overhang portion of the back portion 13) when viewed from the front direction.

The upper portion 12 and an upper part of the back portion 13 are caught together, and accordingly are coupled to form the case 10.

Projection pieces 12*b* and 12*c* are formed on an inner surface of the upper portion 12. The projection pieces 12*b* and 12*c* project in two stages on the front and back sides with a short distance away from a hook-shaped portion 12*a* on the back portion 13. Latch portions 12*d* and 12*e* at distal ends of the projection pieces 12*b* and 12*c*, and latch portions 13*a* and 13*b* formed in two stages on the front and back sides in an inner surface of the upper part of the back portion 13 are caught together and integrated to each other.

The case 10 is made of hard, synthetic resin material. The case 10 is constructed of: a piece obtained by integrally molding the front portion 11 and the upper portion 12 connected to an upper end of the front portion 11; and the back portion 13 integrated by detachably catching the latch portions 12*d* and 12*e* formed on the upper portion 12. They can be separated by sliding the front portion 11 in the lateral direction with respect to the back portion 13.

At least the front portion 11 of the case 10 has transparency so that the inside of the front portion 11 is visible.

The back portion 13 includes an extended back portion 13*c* formed extending further downward than a lower end portion 11*a* of the front portion 11. In the drawing, an area of a length h3 obtained by subtracting a length h2 of the front portion 11 from a length h1 of the back portion 13 is the extended back portion 13*c*.

An inclined portion 14 is formed in such a manner as to form a substantially V shape from a lower end portion of the extended back portion 13*c*, when viewed from the side, and extend substantially linearly in the paper insertion direction (upward in the case 10), when viewed from the side. The insertion opening 17 for paper is formed between an upper end portion 14*a* of the inclined portion 14, and the front portion 11.

An axial support portion 15 for axially supporting a holding piece 20 described below is formed on an inner side of the inclined portion 14 near the upper end portion 14*a*. The axial support portion 15 is formed in such a manner as to project from the inclined portion 14 toward its inner space (a space between the back portion 13 and the inclined portion 14). The axial support portion 15 is formed in such a manner as to have a shorter breadth than that of the inclined portion 14. A hole through which a shaft (illustration omitted) can be inserted is formed in the axial support portion 15 in a lateral direction (the case's width direction) (see FIG. 3).

An outer surface of the front portion 11 is flat. In contrast, a forward inclined portion 11*b* and a backward inclined portion 11*c* are formed on an inner surface of the front portion 11. The forward inclined portion 11*b* has a gentle negative gradient (a gradient toward the front side) sloping from a position in the vicinity of the insertion opening 17 (in the vicinity of the upper end portion 14*a* of the inclined portion 14) toward a position in the vicinity of a pointed end 43 of the blade of when paper is not inserted. The backward inclined portion 11*c* has a gentle positive gradient (a gradient toward the back side) sloping from a position near the pointed end 43 of the blade of when paper is not inserted in the paper insertion direction. An inclined portion 11*d* is formed below the forward inclined portion 11*b*. The inclined portion 11*d* has a gentle negative gradient from the top of the forward inclined portion 11*b*.

The gradients (the angles of inclination) of the forward inclined portion 11*b* and the backward inclined portion 11*c* are within a range of 6 to 20°. The elevation difference of each of the forward inclined portion 11*b* and the backward inclined portion 11*c* (a height up to the top of each inclined portion with respect to a level of the inner surface of the front portion 11 where the pointed end 43 of the blade is positioned when paper is not inserted) is within a range of 0.8 to 3 mm. Furthermore, the length of each of the forward inclined portion 11*b* and the backward inclined portion 11*c* is within a range of 4 to 10 mm. A length between the top of the forward inclined portion 11*b* and the top of the backward inclined portion 11*c* is within a range of 12 to 22 mm. These ranges are preferred from the viewpoint of further ensuring compatibility between two points, being easy to insert paper and hard to drop paper.

By forming the forward inclined portion 11*b* and the backward inclined portion 11*c*, a recess as a whole having gentle curvature when viewed from the side is formed on the inner surface of the front portion 11. The blade's pointed end 43 is positioned between the top of the forward inclined portion 11*b* and the top of the backward inclined portion 11*c* (in a middle portion). The forward inclined portion 11*b* and the backward inclined portion 11*c* may be formed linearly or in an arched or arc shape having a gentle curve, when viewed from the side. The recess formed toward the front portion side between the forward inclined portion 11*b* and the backward inclined portion 11*c*, where the blade's pointed end 43 is positioned, is for avoiding interfering with the operation of the blade's pointed end 43.

The upper end portion 14*a* of the inclined portion 14 is formed substantially parallel to the forward inclined portion 11*b*. The paper insertion opening 17 is formed as a path extending obliquely toward a position near the blade's pointed end 43 of when paper is not inserted, when viewed from the side. The path serves as a path for guiding paper when inserting paper into the case 10. A distal end portion 14*b* at an upper end of the inclined portion 14 is on the paper insertion side and functions as a stopper configured to regulate the movement of a base plate portion 21 of the holding piece 20 described below in a paper pulling direction.

Holding Piece

The holding piece 20 is axially supported rotatably by the axial support portion 15 provided inside the case 10. Furthermore, the holding piece 20 is biased by spring force of the elastic member 30 in the paper pulling direction. The holding piece 20 is provided with a blade 40 such that the pointed end 43 of the blade 40 projects from an end of the holding piece 20 (the end on the front portion side) toward the front portion 11.

Figure 3:
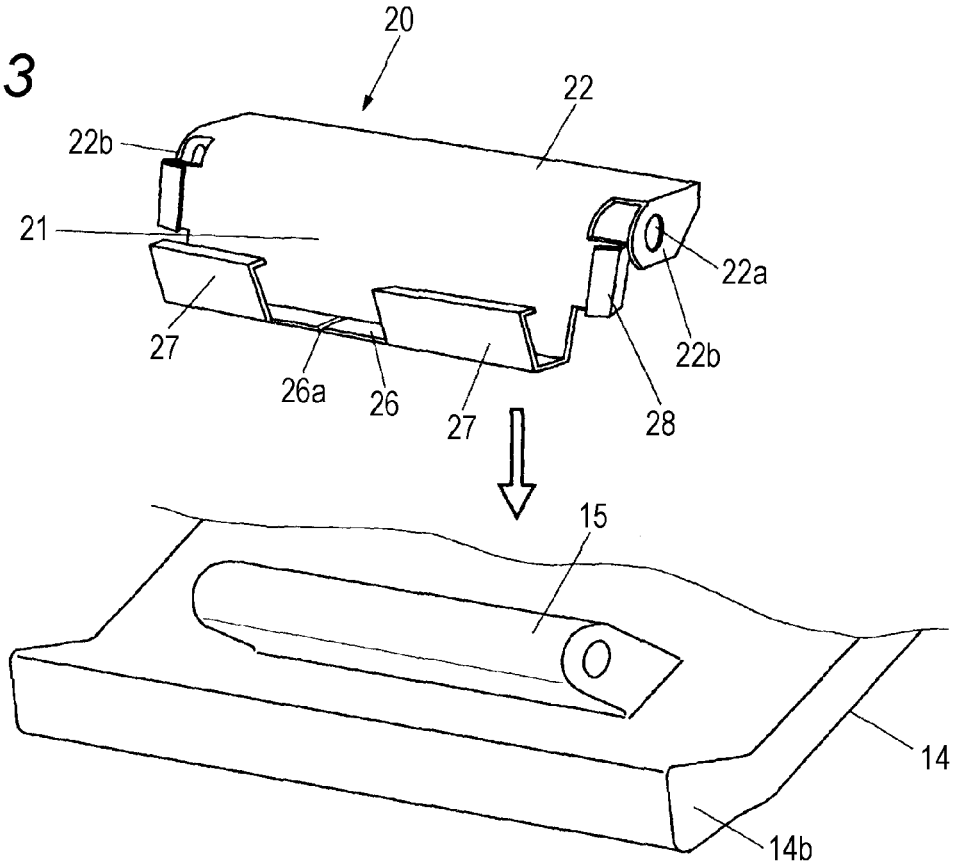
FIG. 3 is a perspective view illustrating a holding piece 20 and an axial support portion 15.

The holding piece 20 is formed with, for example, a bent plate body having required rigidity as illustrated in FIG. 3. The holding piece 20 is axially supported rotatably by the axial support portion 15 provided on the inner side of the inclined portion 14. The holding piece 20 includes the base plate portion 21 extending from the axial support portion 15 toward the front portion 11 side.

The holding piece 20 is formed with a plate body having rigidity and accordingly can be easily made by processing of the plate body, and the like. The holding piece 20 can be formed with, for example, a metal plate such as an SK material or stainless steel material having a thickness of approximately 0.1 to 0.3 mm. The breadth of the holding piece 20 is, for example, approximately 2 to 4 cm.

The holding piece 20 includes a mounting surface portion 22 that is bent in a substantially dogleg shape when viewed from the side and is continuous to the base plate portion 21. The holding piece 20 is axially supported by the axial support portion 15 near a round bent portion where the base plate portion 21 intersects with the mounting surface portion 22.

The holding piece 20 is axially supported rotatably by the axial support portion 15 provided on the inner side of the inclined portion 14. The holding piece 20 includes the base plate portion 21 extending from the axial support portion 15 toward the front portion 11 side. Hence, the holding piece 20 is placed, making use of the most of a space formed between the front portion 11 and the back portion 13. Therefore, an increase in the size of the product is not invited and a large rotation radius of the holding piece 20 (and the blade) can be taken in the limited narrow space. Therefore, smooth and stable operation of the holding piece 20 is ensured when paper is inserted and pulled out.

As illustrated in FIG. 3, both end portions of the mounting surface portion 22 of the holding piece 20 are bent at a right angle. Mounting portions 22*b* and 22*b* each including a shaft insertion hole 22*a* for allowing the shaft to pass through are formed at both end portions. The holding piece 20 is axially supported by the axial support portion 15 by placing the mounting portions 22*b* and 22*b* on both of the left and right end portions of the axial support portion 15, passing the shaft (illustration omitted) through the hole of the axial support portion 15 and the shaft insertion holes 22*a* of the mounting portions 22*b*, and stopping the shaft by a stopper (for example, an elastic tubular body such as silicon rubber) as appropriate. Therefore, the holding piece 20 is detachable from the case 10.

Moreover, an end (the front portion side) of the base plate portion 21 of the holding piece 20 is bent against the paper insertion side to form a bent portion 26. Furthermore, a latch portion 27 for placing a blade fixing member 50 described below at a predetermined position (in the longitudinal direction) is connected to the end of the base plate portion 21. The latch portion 27 is fixed by being caught by the blade fixing member 50 described below.

Moreover, latch portions 28 for placing the blade fixing member 50 described below at a predetermined position (in the lateral direction) are connected to both of left and right ends of the base plate portion 21 of the holding piece 20.

A slit 26*a* is formed in the center of the bent portion 26 in the width direction. The blade fixed to the blade fixing member 50 passes through the slit 26*a*. The bent portion 26 and the latch portion 27 serve as longitudinal positioning portions for the blade fixing member 50 described below. The slit 26*a* and the latch portions 28 serve as lateral positioning portions for the blade fixing member 50 provided with the blade 40. The pointed end 43 of the blade 40 projects from the bottom side end of the base plate portion 21 through the slit 26*a*.

Elastic Member

The elastic member 30 biases the holding piece 20 by means of spring force in the paper pulling direction.

Figure 4:
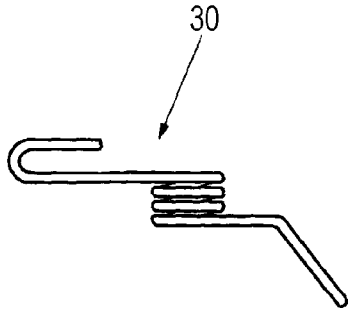
FIG. 4 is a plan view of an elastic member 30.

In the embodiment, a coil spring is used as illustrated in FIGS. 1 and 4. Both ends of a wire rod of a coil spring 30 projects in tangent directions. One of the ends is inserted into a hole provided in the blade fixing member 50 described below. Furthermore, the other end is in contact with an inner surface of the back portion 13. Consequently, the holding piece 20 is biased by the spring force.

Blade

A blade made of steel such as carbon tool steel (SK) used for a blade of a cutter is suitably used as the blade 40. Its thickness is normally approximately 0.3 to 1.2 mm.

Figure 5:
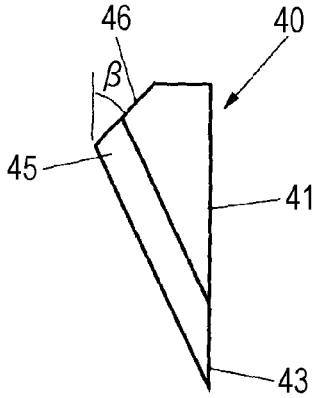
FIG. 5 is a side view of a blade 40.

As illustrated in FIG. 5, the blade 40 includes a spine portion 41 extending linearly, an edge 44, a heel 45 (a rear part of the edge 44), and an inclined side portion 46. The edge 44 intersects with the spine portion 41 and forms an acute-angled pointed end (point) 43 of the blade. The heel 45 is positioned facing to the spine portion 41. The inclined side portion 46 extends at a tilt from the vicinity of the heel 45 toward the spine portion 41. An inclination angle β of the inclined side portion 46 is within a range of approximately 30 to 60°. The angle of the pointed end 43 of the blade 40 is normally approximately 20 to 40°. The length of the edge 44 of the blade 40 is, for example, approximately 5 to 10 mm.

The blade 40 has a shape including the spine portion 41 and the edge 44, which intersect to form the acute-angled pointed end 43 of the blade, and the inclined side portion 46 formed extending at a tilt from the vicinity of the heel 45 toward the spine portion 41. Hence, the blade 40 is strategically placed in the narrow internal space of the case 1. The movement of the holding piece 20 including the blade 40 is not interfered by the case 1 so that the blade 40 and the holding piece 20 reliably operate.

Blade Fixing Member

The blade fixing member 50 is a member that fixes and holds the blade 40 at a predetermined position, and is attached to the base plate portion 21 of the holding piece 20. The blade fixing member 50 is provided with the blade 40 such that the pointed end 43 of the blade 40 projects. Moreover, the blade 40 is fixed to the blade fixing member 50 in such a manner as to hold a perpendicular standing state of the blade 40 with respect to a surface of the base plate portion 21.

Figure 6:
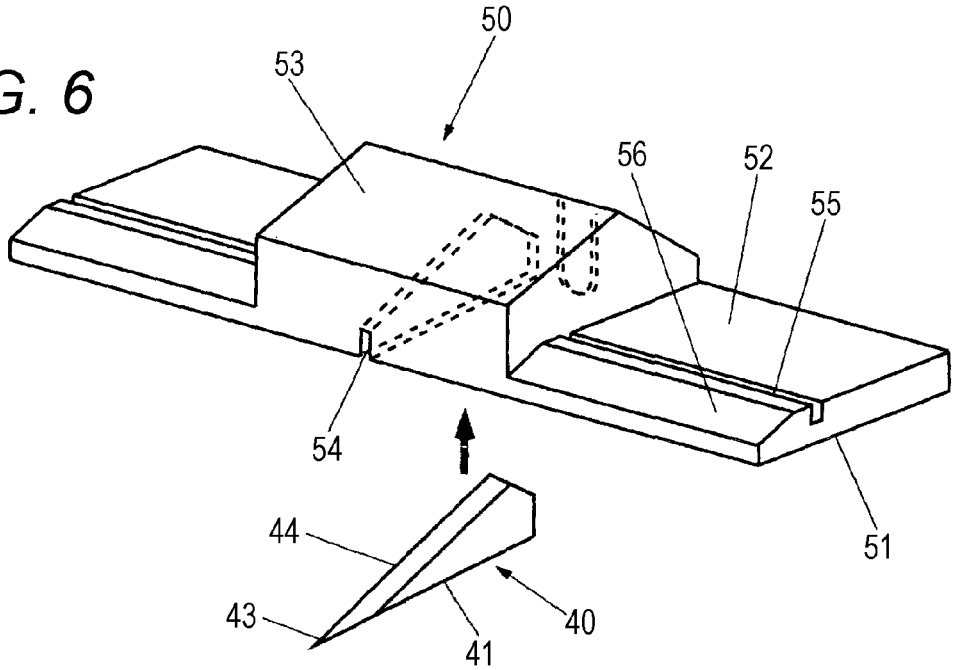
FIG. 6 is a perspective view of a blade-fixing member 50.

As illustrated in FIG. 6, the blade fixing member 50 includes a base portion 52 and a standing portion 53 for housing and fixing the blade 40. The base portion 52 includes a flat portion (bottom surface portion) 51 fixed to the base plate portion 21 of the holding piece 20. The standing portion 53 stands perpendicularly from the base portion 52. The standing portion 53 holds a flat portion (flat) of the blade 40 from both sides. The standing portion 53 has a height adapted for the height of the blade 40. A slit 54 fitting the outline of the blade 40 is formed in the standing portion 53. The perpendicular state of the blade 40 with respect to the base portion 52 is held by inserting and fixing the blade 40 in and to the slit 54. The blade fixing member 50 can be constructed of a synthetic resin molded product.

The blade fixing member includes the base portion 52 that can be fixed to the holding piece 20, and the standing portion 53 that stands perpendicularly from the base portion 52 and holds the flat portion of the blade from both sides. Hence, the blade fixing member 50 has a simplified structure and low production cost.

The blade 40 is fixed to the blade fixing member 50 that holds the perpendicular standing state of the blade with respect to the holding piece 20. The blade fixing member 50 is provided on a surface of the base plate portion 21 in the paper insertion side such that the pointed end of the blade 40 projects from the end (the slit 26*a*) of the base plate portion 21 on the front portion 11 side. Hence, the blade is reliably held by the blade fixing member 50 in such a manner as to be placed in a predetermined position and orientation. Furthermore, the attachment and assembly of the blade to the holding piece 20 using the blade fixing member 50 is easy.

The blade fixing member 50 is fixed to the inner surface of the base plate portion 21 of the holding piece 20 in the paper insertion side by the flat portion 51 of the base portion 52. The fixing member 50 is fixed such that the base portion 52 is aligned to the bent portion 26 at the lower end of the base plate portion 21. The blade 40 is fixed in such a manner as to hold the perpendicular standing state of the blade with respect to the surface of the base plate portion 21. Furthermore, the blade 40 is provided such that the pointed end 43 of the blade 40 projects from the end on the front portion 11 through the slit 26*a* of the base plate portion 21. The spine portion 41 of the blade 40 is attached along the base plate portion 21.

In this case, the blade 40 includes the spine portion 41 and the edge 44, which intersect to form the acute-angled pointed end 43 of the blade, and the inclined side portion 46 extending at a tilt from the vicinity of the heel 45 toward the spine portion 41. Hence, the blade 40 is strategically placed in the narrow internal space of the case. Hence, the movement of the blade is not interfered (the side facing to the spine portion 41 does not collide with the latch portion 13*a* of the back portion 13, and the like) with the movement of the base plate portion 21. Therefore, the holding piece 20 including the blade 40 reliably operates.

In the embodiment, a recessed groove portion 55 can catch the latch portion 27 connected to the bent portion 26 of the base plate portion 21 of the holding piece 20. The recessed groove portion 55 is formed on the surface of the base portion 52. A taper portion 56 reducing in thickness toward one end is formed closer to the end side than the recessed groove portion 55. Hence, the blade fixing member 50 can be easily attached to the base plate portion 21.

Therefore, the blade fixing member 50 can be easily attached at a predetermined position of the base plate portion 21 of the holding piece 20 in reliable manner.

In addition to the above, the blade fixing member 50 can be fixed to the base plate portion 21 using double-sided adhesive tape, an adhesive, or some other appropriate fixing means.

As illustrated in FIGS. 1 and 2, a flat through hole (or recess) 11*e* is formed on the front portion 11 of the case 10 in the vicinity where the pointed end 43 of the blade 40 is located, as appropriate. The pointed end 43 of the blade 40 is housed in the space of the through hole 11*e*. As described above, the distal end portion 14*b* is formed at the upper end of the inclined portion 14. Hence, the movement of the base plate portion 21 of the holding piece 20 in the paper pulling direction is regulated while the distal end portion 14*b* serves as a stopper. Hence, the pointed end 43 of the blade 40 does not come into contact with the front portion 11 and thus protected from damage and the like.

Moreover, the spine portion 41 of the blade 40 is placed along the base plate portion 21 of the holding piece 20 at a slight tilt in the paper insertion direction. Hence, paper is also inserted easily.

Installment

Figure 7:
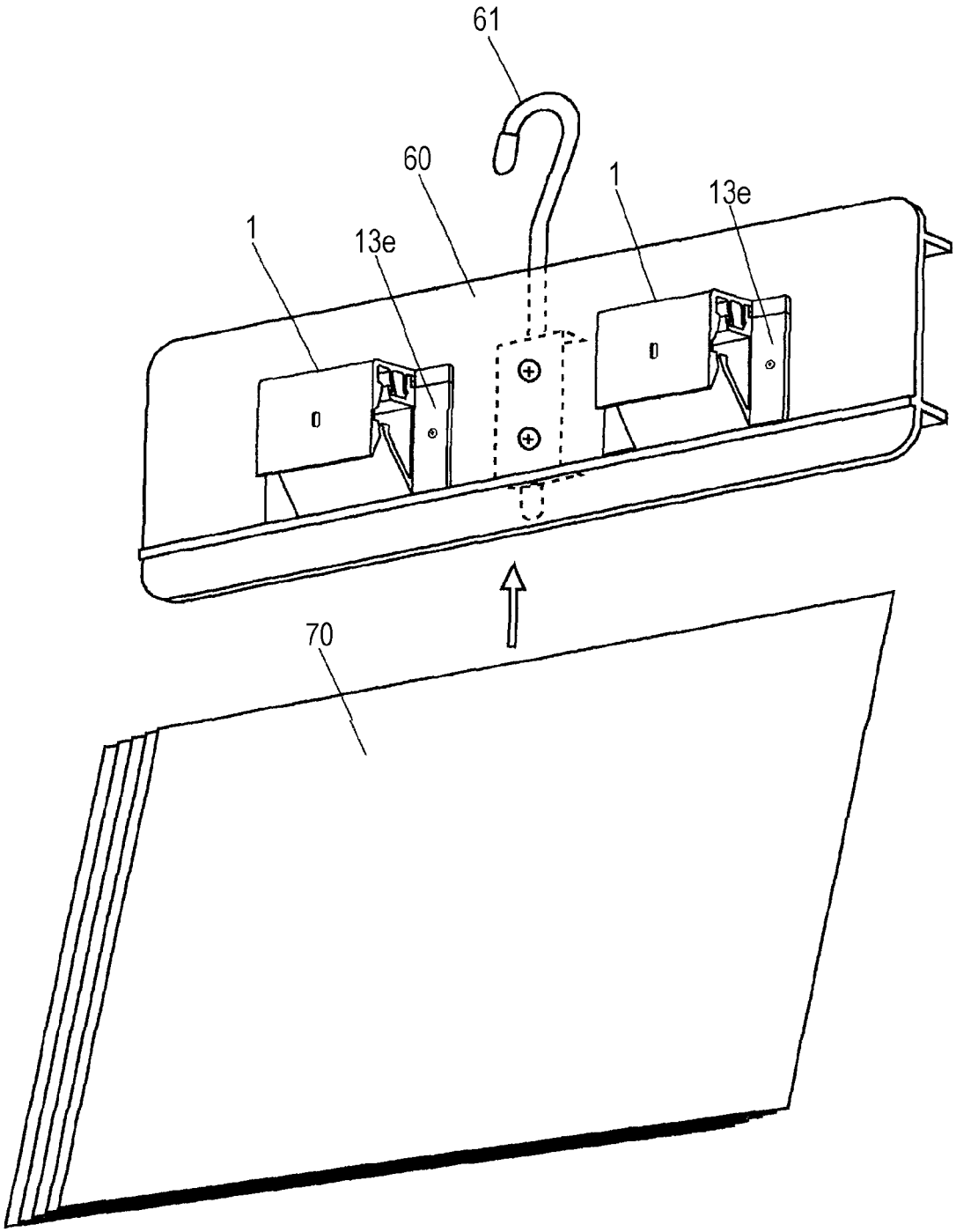
FIG. 7 is a perspective view illustrating the usage of the paper holder 1.

The installment direction, installment location, and installment means of the paper holder 1 are not limited. The paper holder 1 can be installed on various wall portions with adhesive tape or the like attached to the back side of the case 10 (the outer surface of the front portion 11). A plurality of paper holders 1 can also be installed side by side on a horizontally oriented plate and used according to the size of paper to be held. A usage example suitable for use in factories and the like is illustrated in FIG. 7.

Two paper holders 1 are respectively fixed to a plate body 60 by means such as screws at the overhang portions 13*e* formed on both sides of the back portions 13. A hanger 61 is attached to the plate body 60. The hanger 61 can be used by being caught at an appropriate position. A reference sign 70 denotes paper.

Operation

The operation of the paper holder 1 is described with reference to FIGS. 8 and 9.

Figure 8:
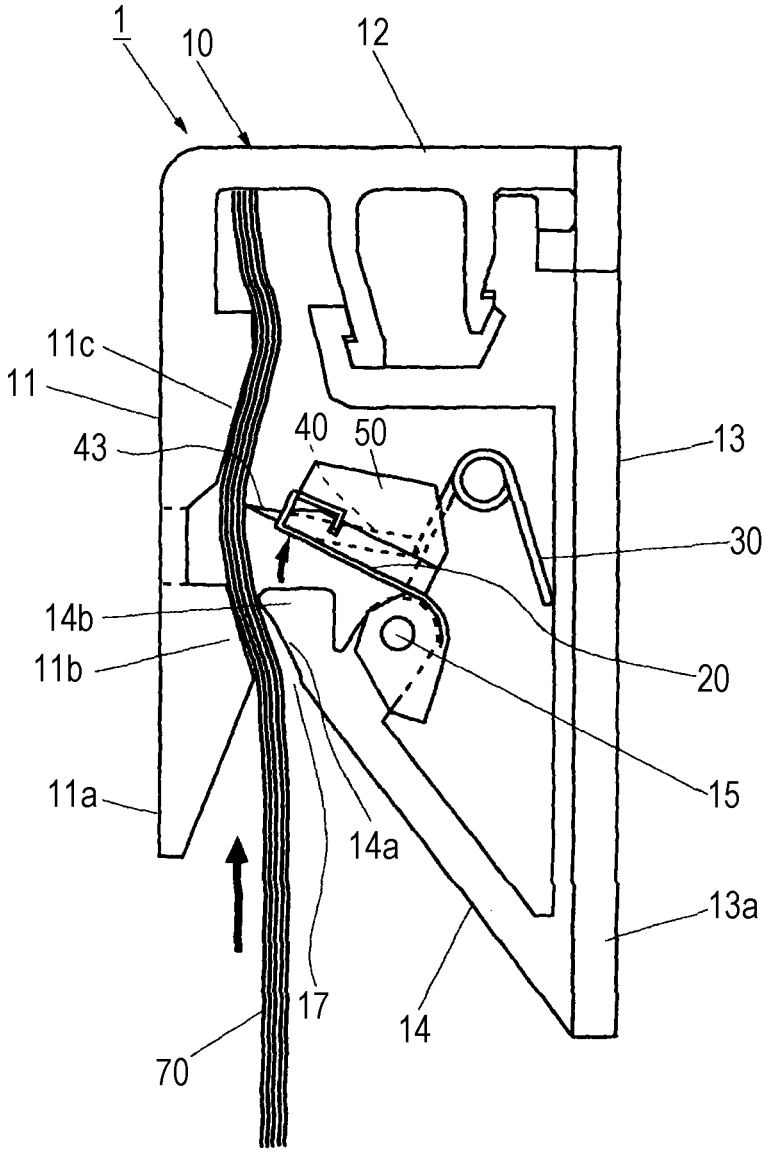
FIG. 8 is an explanatory view of the operation of the paper holder 1.
Figure 9:
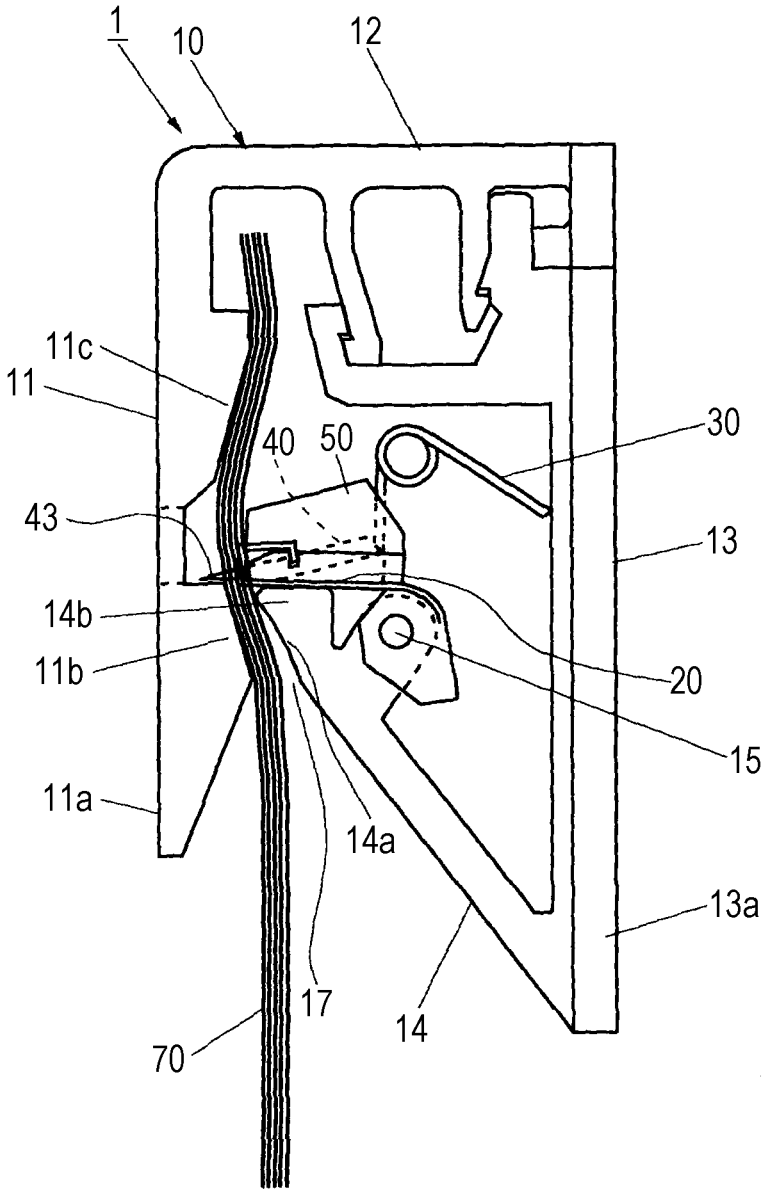
FIG. 9 is an explanatory view of the operation of the paper holder 1.

FIG. 8 illustrates a state where the paper 70 has been inserted from the insertion opening 17 in the direction indicated by the arrow in the figure. FIG. 8 illustrates a state where the frontmost sheet of the inserted paper 70 is pulled out.

As illustrated in FIG. 8, stacked multiple (normally, approximately 5 to 10) sheets of the paper 70 are inserted from the insertion opening 17 to the inside of the case 10 first, as appropriate. Then, a leading end of the paper 70 lightly hits the spine portion 41 of the blade 40. Furthermore, when continuing to be inserted against the spring force of the elastic member 30 toward the insertion opening side, the spring force being applied to the holding piece 20, the paper 70 advances further inside. In this case, the base plate portion 21 of the holding piece 20 pivots on the axial support portion 15 in the direction of the arrow in the figure (the insertion direction side). The spring force applied to the holding piece 20 acts such that the pointed end 43 of the blade 40 holds the paper 70 in between with the front portion 11. The pointed end 43 of the blade 40 comes into contact with a sheet located on the back portion side among the inserted paper 70 and normally thrusts the sheet slightly. The leading end of the paper 70 is inserted beyond the backward inclined portion 11*c*.

Furthermore, after being inserted in this manner, the whole paper 70 is slightly pulled downward. The holding piece 20 returns toward the pulled direction together with the spring force acting thereon, and returns to its original state as illustrated in FIG. 9. The paper 70 is held in between with the front portion 11 while the whole of the paper 70 is thrust by the pointed end 43 of the blade 40.

As described above, the forward inclined portion 11*b* and the backward inclined portion 11*c* are formed on the inner surface of the front portion 11. The forward inclined portion 11*b* has a gentle negative gradient sloping from the position near the insertion opening 17 (the upper end portion 14*a* of the inclined portion 14) toward the position near the pointed end 43 of the blade. The backward inclined portion 11*c* has a gentle positive gradient sloping from the position near the pointed end 43 of the blade toward the insertion direction of the paper 70. Hence, as illustrated, the pressing force of the pointed end 43 of the blade 40 acts on the inserted paper 70 between the forward inclined portion 11*b* and the backward inclined portion 11*c* (between the top of the forward inclined portion 11*b* and the top of the backward inclined portion 11*c*) such that the paper 70 warps like an arch bulging downward when viewed from the side. Therefore, the coefficients of friction of multiple sheets of the paper 70 increase between sheets compared with a case without the above warp of the paper 70. Hence, multiple sheets of the paper 70 as a whole are reliably held. Therefore, the paper holder 1 is used vertically in many cases. In the case of vertical use, paper positioned on the back portion side and in the middle is prevented from dropping off. If the forward inclined portion 11*b* and the backward inclined portion 11*c* do not exist, the above warp of the paper 70 does not occur. Accordingly, paper is likely to drop off.

Moreover, as described above, the upper end of the inclined portion 14 is formed substantially parallel to the forward inclined portion 11*b*. The paper insertion opening 17 is formed as a path extending obliquely toward a position in the vicinity of the blade's pointed end 43 of when paper is not inserted, when viewed from the side. Hence, when paper is inserted into the case 10, the path serves the function of guiding the paper slightly obliquely from the back surface side to the front surface side. The contact angle of the blade 40 with the spine portion 41 (and the pointed end 43) is reduced. Accordingly, the resistance to the blade 40 is reduced. Hence, paper can be inserted smoothly. Moreover, the forward inclined portion 11*b* and the backward inclined portion 11*c* are formed to have a gentle gradient. Accordingly, the paper 70 is guided along the gradients. Therefore, the paper 70 can be smoothly inserted and pulled out.

Furthermore, the inclined portion 14 is formed extending substantially linearly from the lower end portion of the extended back portion 13*c* in the paper insertion direction, when viewed from the side. The paper insertion opening 17 is formed between the upper end portion 14*a* of the inclined portion 14, and the front portion 11. Hence, when the paper 70 is inserted, the paper 70 is guided to the insertion opening 17 smoothly and reliably.

Figure 10:
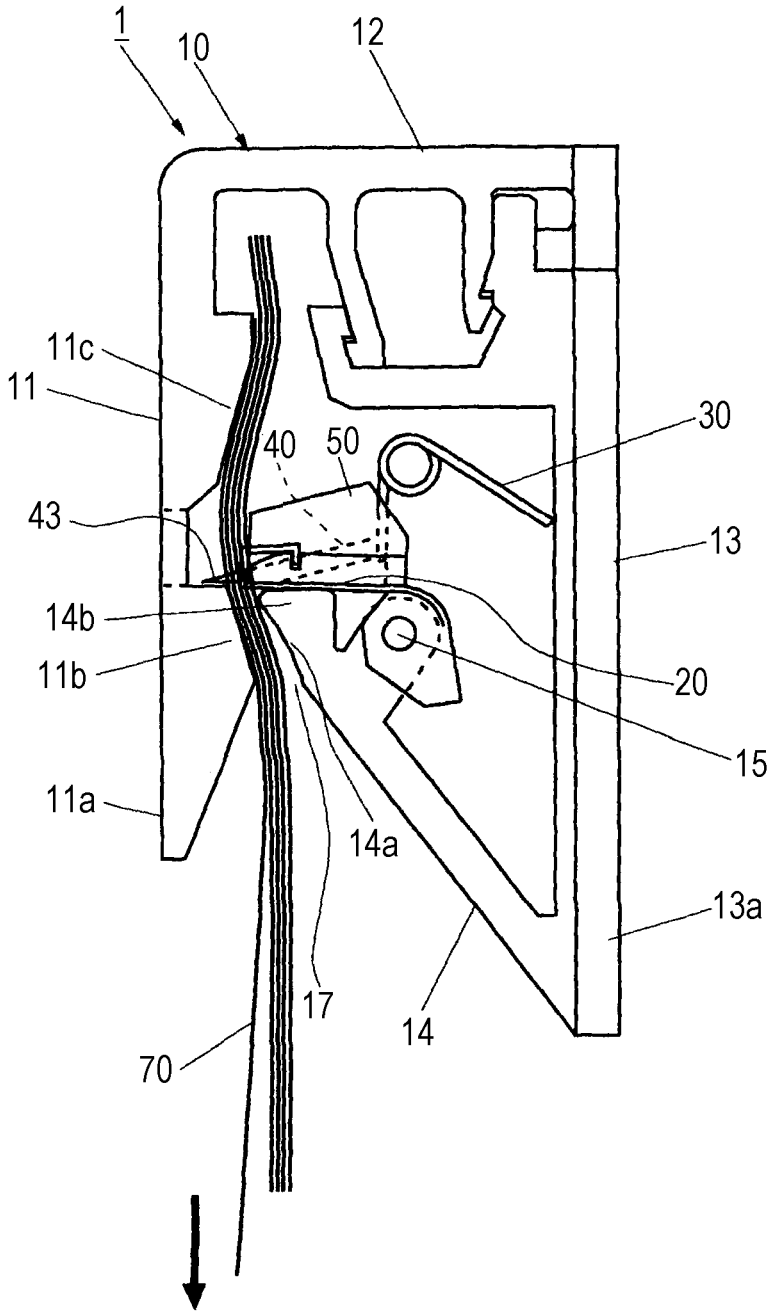
FIG. 10 is an explanatory view of the operation of the paper holder 1.

If the frontmost sheet becomes unnecessary, the sheet is pulled out from the insertion opening 17 in the direction indicated by the arrow as illustrated in FIG. 10. In this case, the pointed end 43 of the blade 40 is thrusting the paper 70, and only the frontmost sheet is pulled out. In other words, while the other sheets are kept held without dropping off, only the frontmost sheet is pulled out.

As described above, the forward inclined portion 11*b* and the backward inclined portion 11*e* are formed on the inner surface of the front portion 11. The forward inclined portion 11*b* has a gentle negative gradient sloping from the position in the vicinity of the insertion opening 17 (the upper end portion 14*a* of the inclined portion 14) toward the position in the vicinity of the pointed end 43 of the blade. The backward inclined portion 11*c* has a gentle positive gradient sloping from the position in the vicinity of the pointed end 43 of the blade in the paper insertion direction. Hence, as illustrated, the pressing force of the pointed end 43 of the blade 40 acts on the inserted paper 70 between the forward inclined portion 11*b* and the backward inclined portion 11*c* (between the top of the forward inclined portion 11*b* and the top of the backward inclined portion 11*c*) such that the paper 70 warps like an arch bulging toward the front side when viewed from the side. Therefore, the coefficients of friction of multiple sheets of the paper 70 increase between sheets. Hence, multiple sheets of the paper 70 as a whole are reliably held. Accordingly, only the topmost sheet can be reliably pulled out. The paper holder 1 is used vertically in many cases. Vertical use prevents paper positioned on the back portion side and in the middle from dropping off together. If the forward inclined portion 11*b* and the backward inclined portion 11*c* do not exist, the above warp of the paper 70 does not occur. Accordingly, paper is likely to drop off.

The front most sheet to be pulled out is pulled out while being thrust by the pointed end 43 of the blade 40. Hence, a straight, neat cutting line (trace) starting from a contact point where having been thrust by the pointed end 43 of the blade 40 to the leading end of the sheet is formed. Moreover, the contact angle with the edge 44 of the blade 40 of when the paper 70 is pulled out is also reduced by the warp of the paper due to the existence of the backward inclined portion 11*c*, compared with the case without the backward inclined portion 11*c*. Hence, cutting is performed more smoothly, and a neat cutting line can be obtained.

Paper positioned on the front side can be easily pulled out one by one by repeating the above operations in a reliable manner.

DESCRIPTION OF REFERENCE SIGNS

1 Paper holder
10 Case
11 Front portion
12 Upper portion
13 Back portion
13*c* Extended back portion
14 Inclined portion
15 Axial support portion
17 Insertion opening
20 Holding piece
30 Elastic member
40 Blade

43 Pointed end of the blade
70 Paper

The invention claimed is:

1. A paper holder comprising:
a case including
a front portion,
a back portion disposed with a space from the front portion and facing to the front portion substantially in parallel,
an upper portion connecting the front portion and the back portion, and
an insertion opening configured to receive paper between the front portion and the back portion from below; and
a holding piece axially rotatably supported by an axial support portion provided inside the case and biased by a spring force in a direction of pulling out the paper, and including a paper cutting blade configured to project from an end of the holding piece toward the front portion,
a pointed end of the paper cutting blade being configured to be brought into contact with the paper inserted from the insertion opening to hold the paper, wherein
the back portion includes
an extended back portion formed extending further downward than a lower end portion of the front portion, and
an inclined portion extending substantially linearly from a lower end portion of the extended back portion in the paper insertion direction, when viewed from the side, the axial support portion is provided on an inner side of the inclined portion, and the front portion has transparency.

2. A paper holder comprising:
a case including
a front portion,
a back portion disposed with a space from the front portion and facing to the front portion substantially in parallel,
an upper portion for connecting the front portion and the back portion, and
an insertion opening for inserting paper into between the front portion and the back portion from below; and
a holding piece axially rotatably supported by an axial support portion provided inside the case and biased by a spring force in a direction of pulling out the paper, and including a paper cutting blade configured to project from an end of the holding piece toward the front portion,
a pointed end of the paper cutting blade being configured to be brought into contact with the paper inserted from the insertion opening to hold the paper, wherein
the back portion includes
an extended back portion formed extending further downward than a lower end portion of the front portion, and
an inclined portion extending substantially linearly from a lower end portion of the extended back portion in the paper insertion direction, when viewed from the side, the axial support portion is provided on an inner side of the inclined portion, and the front portion has transparency,
where the front portion, the back portion, and the upper portion form a substantially U-shaped structure with the insertion opening, and define an internal space.

3. The paper holder of claim 2 where the inclined portion extends along the insertion opening in such a manner as to form within the U-shaped structure a substantially V shaped structure and the internal space.

4. The paper holder of claim 2 where the holding piece has a planar structure.

5. A paper holder comprising:
a case including
a front portion,
a back portion disposed with a space from the front portion and facing to the front portion substantially in parallel,
an upper portion for connecting the front portion and the back portion, and
an insertion opening for inserting paper into between the front portion and the back portion from below; and
a holding piece axially rotatably supported by an axial support portion provided inside the case and biased by a spring force in a direction of pulling out the paper, and including a paper cutting blade configured to project from an end of the holding piece toward the front portion,
a pointed end of the paper cutting blade being configured to be brought into contact with the paper inserted from the insertion opening to hold the paper, wherein
the back portion includes
an extended back portion formed extending further downward than a lower end portion of the front portion, and
an inclined portion extending substantially linearly from a lower end portion of the extended back portion in the paper insertion direction, when viewed from the side, the axial support portion is provided on an inner side of the inclined portion, and the front portion has transparency,
where the front portion, the back portion, and the upper portion form a substantially U-shaped structure with the insertion opening, and define an internal space, and
where the paper cutting blade within the internal space and is movable across the insertion opening.

6. The paper holder of claim 1 in which the spring force is provided by an elastic member.

7. The paper holder of claim 6 where the elastic member is a coiled spring.

8. The paper holder of claim 1 wherein the upper portion is connected to the front portion in an integrated manner.

9. The paper holder of claim 1 wherein the paper is inserted within the case between the front portion and the holding piece.

10. The paper holder of claim 1 wherein with the paper inserted within the case, the holding piece is hidden from view from the front.

11. The paper holder of claim 1 wherein the paper cutting blade is positioned within the case such that as the paper is inserted through the insertion opening, a leading edge of the paper contacts a spine portion of the paper cutting blade to thereby rotate the paper cutting blade and the holding piece away from the insertion opening.

12. The paper holder of claim 1 wherein the paper cutting blade comprises a sharp edge formed along one side thereof, the paper cutting blade being oriented such that the sharp edge points away from the insertion opening.

13. The paper holder of claim 1 wherein as the paper is removed from the case, the paper cutting blade cuts the paper along a straight cutting line.

14. The paper holder of claim 13 wherein an interior surface of the front portion includes a backward inclined portion configured to reduce a contact angle between the paper and the paper cutting blade as the paper is removed from the case.

* * * * *